US005465425A

United States Patent [19]

Crispin

[11] Patent Number: 5,465,425

[45] Date of Patent: Nov. 14, 1995

[54] FISHING GARMENT WITH REMOVABLE POCKETS WITH FASTENING MEANS ON BOTH POCKETSIDES

[76] Inventor: Harold D. Crispin, P.O. Box 222, Flora Vista, N.M. 87415

[21] Appl. No.: 198,293

[22] Filed: Feb. 18, 1994

[51] Int. Cl.[6] ..... A41D 1/04

[52] U.S. Cl. ..... 2/102; 2/94; 2/247; 2/108

[58] Field of Search ..... 2/102, 108, 94, 2/247, 69, 48, 49.1, 49.2, 50, 51, 85, 90, 93, 105, 106, 243.1, 912, 913, 919

[56] References Cited

U.S. PATENT DOCUMENTS

| | | | |
|---|---|---|---|
| 725,903 | 4/1903 | Wilcomb | 2/94 |
| 1,520,962 | 12/1924 | North | 2/94 |
| 3,624,686 | 11/1971 | Beals | 2/247 |
| 4,602,390 | 7/1986 | Morera et al. | 2/247 |
| 5,063,614 | 11/1991 | McSheffery | 2/247 |

*Primary Examiner*—C. D. Crowder
*Assistant Examiner*—Gloria Hale

[57] ABSTRACT

A garment adapted for wear by a sportsperson. The garment includes a support member in a generally square configuration having long side edges and short end edges. An oval head opening is centrally disposed therein. The larger axis of the oval is parallel with the end edges and the smaller axis is parallel with the side edges. A slit is formed in the center of one of the end edges extending to the head opening to facilitate donning and removing of the garment. A plurality of permanently fixed or removable pockets are also provided. Each pocket has a back face and a front face with coupling components interconnecting the support member and the pockets.

4 Claims, 4 Drawing Sheets

FISHING GARMENT WITH REMOVABLE POCKETS WITH FASTENING MEANS ON BOTH POCKETSIDES

BACKGROUND OF THE INVENTION

1. Field of the Invention

The present invention relates to fishing garments with removable pockets and more particularly pertains to a garment particularly adapted for wear by sportspersons needing easier access to rear pockets, desiring to wade into deep water without getting the garment wet and wanting to don or remove other items of apparel such as waders, jackets and the like without removing the garment, the garment having a support member and a plurality of pockets and coupling means for coupling of the pockets to the support member.

2. Description of the Prior Art

The use of fishing garments is known in the prior art. More specifically, fishing garments heretofore devised and utilized for the purpose of supporting a side variety of articles used by fishermen are known to consist basically of familiar, expected and obvious structural configurations, notwithstanding the myriad of designs encompassed by the crowded prior art which have been developed for the fulfillment of countless objectives and requirements.

A wide variety of prior art devices have been devised to be worn by fishermen or other sports persons to support articles used while fishing.

By way of example, note U.S. Pat. No. 3,885,248 to Salsby directed to a hunting vest. Note also U.S. Pat. No. 5,014,359 to Hanson which discloses a vest and backpack combination with a large number of pockets. In addition, U.S. Pat. Nos. Des. 305,825 to Tenore; Des. 315,632 to Boyle and Des. 273,910 to Teeny discloses vests for fishermen with pluralities of pockets disposed at convenient locations.

In this respect, the garment according to the present invention substantially departs from the conventional concepts and designs of the prior art, and in so doing provides an apparatus primarily developed for the purpose of providing permanently fixed or removable pockets which provide access to a rear pocket or pockets, which allows wading in deep water without getting the garment wet and which permits donning and removal of other items of apparel without removing the garment.

Therefore, it can be appreciated that there exists a continuing need for new and improved pockets which can be used by fishermen and other sports persons to maintain their devices in convenient proximity. In this regard, the present invention substantially fulfills this need.

SUMMARY OF THE INVENTION

In view of the foregoing disadvantages inherent in the known types of fishing garments with permanently fixed or removable pockets now present in the prior art, the present invention provides an improved removability construction wherein the same can be utilized for positioning the pockets in a particular orientation for a particular person and application. As such, the general purpose of the present invention, which will be described subsequently in greater detail, is to provide a new and improved fishing garment apparatus and method which has all the advantages of the prior art and none of the disadvantages.

To attain this, the present invention essentially comprises a garment adapted for wear by a sportsperson comprising a support member in a generally square configuration having side edges and end edges, an oval head opening centrally disposed therein with larger axis of the oval being parallel with the end edges and with the smaller axis parallel with the side edges, a slit in the center of one of the end edges extending to the head opening to facilitate donning are removing of the garment; a plurality of pockets, each pocket having a back face and a front face; and coupling means interconnecting the support means and the pockets. The coupling means may include a plurality of strips of pile type fasteners secured to the exterior of the support member in spaced relationship and a plurality of strips of pile type fasteners secured to the back faces of the pockets in spaced relationship.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fishing garment with pockets which has all the advantages of the prior art and none of the disadvantages.

It is another object of the present invention to provide a new and improved fishing garment with pockets which may be easily and efficiently manufactured and marketed.

It is a further object of the present invention to provide a new and improved fishing garment with pockets which is of a durable and reliable construction.

An even further object of the present invention is to provide a new and improved fishing garment with pockets which is susceptible of a low cost of manufacture with regard to both materials and labor, and which accordingly is then susceptible of low prices of sale to the consuming public, thereby making such fishing garments economically available to the buying public.

Still yet another object of the present invention is to provide a new and improved fishing garment with removable pockets which provides in the apparatuses and methods of the prior art some of the advantages thereof, while simultaneously overcoming some of the disadvantages normally associated therewith.

Still another object of the present invention is to position and/or reposition pockets on a sportsperson's garment at locations to meet the desires of the sportsperson for a particular time and place.

Yet another object of the present invention is to utilize an ever increasing number of pockets by placing one above the other in a stacked configuration for increasing the storage space of a fisherman.

Even still another object of the present invention is to render fishing more convenient and enjoyable by rendering the fishing apparel of greater convenience.

Lastly, it is another object to provide a garment adapted for wear by a sportsperson comprising a support member in a generally rectangular configuration having side edges and end edges, an oval head opening centrally disposed therein with larger axis of the oval being parallel with the end edges and with smaller axis parallel with the side edges, a slit in the center of one of the end edges extending to the head opening to facilitate donning and removing of the garment; a plurality of pockets, each pocket having a back face and a front face; and coupling means interconnecting the support means and the pockets. The coupling means may include a plurality of strips of pile type fasteners secured to the exterior of the support member in spaced relationship and a plurality of strips of pile type fasteners secured to the back faces of the pockets in spaced relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals are used to designate the same parts throughout the various Figures.

DESCRIPTION OF THE PREFERRED EMBODIMENT

Figure 1:
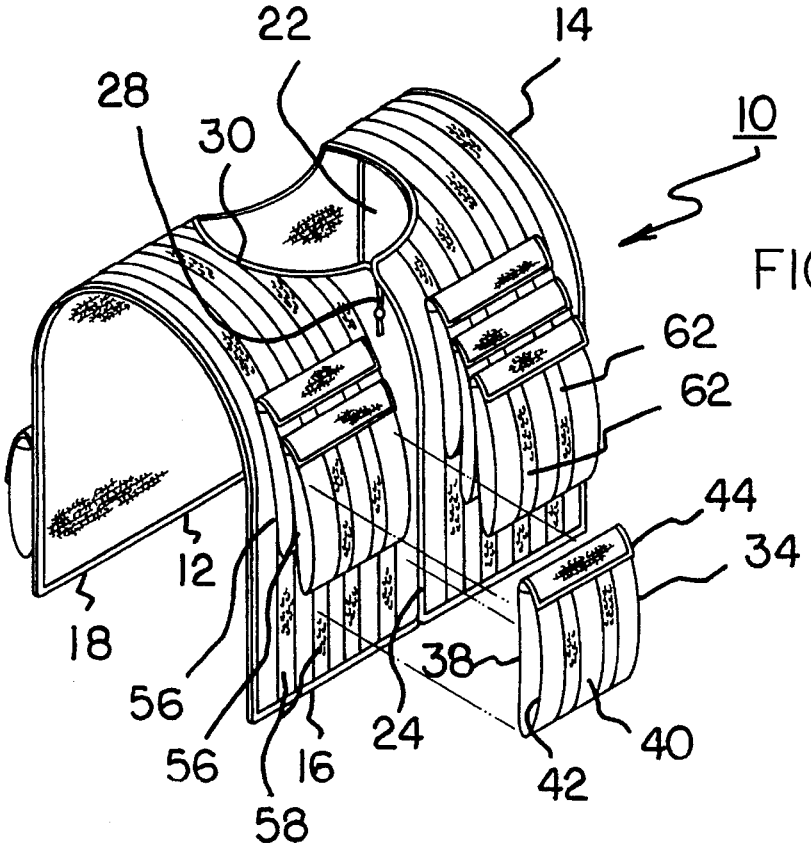
FIG. 1 is a perspective view of the fishing garment with pockets constructed in accordance with the principles of the present invention.
Figure 2:
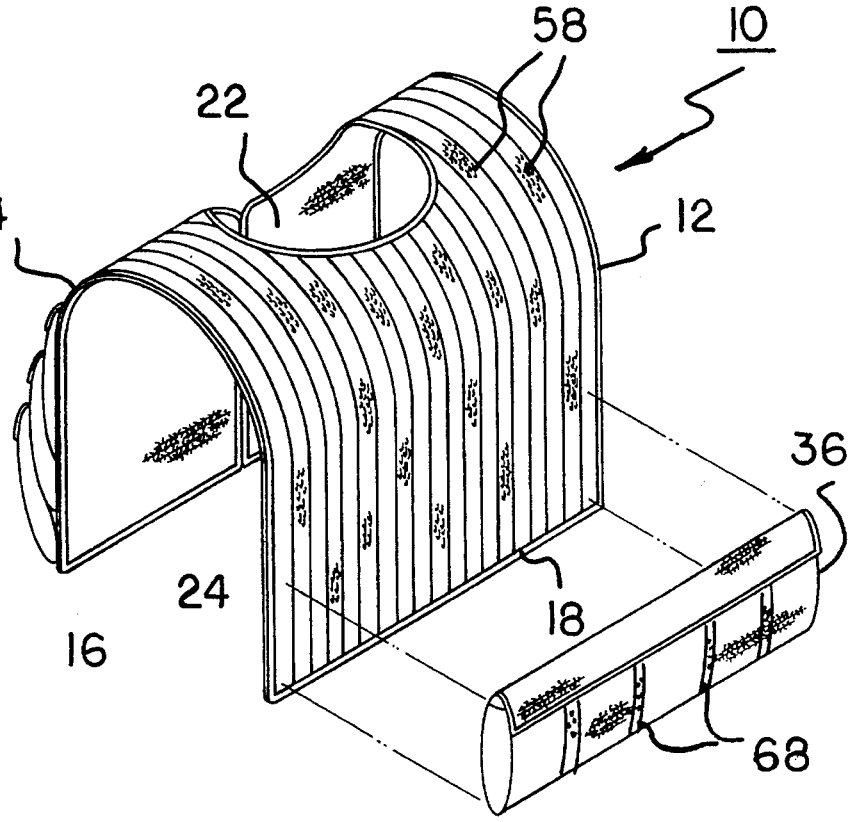
FIG. 2 is a perspective rear view of the fishing garment with pockets as shown in FIG. 1.
Figure 3:
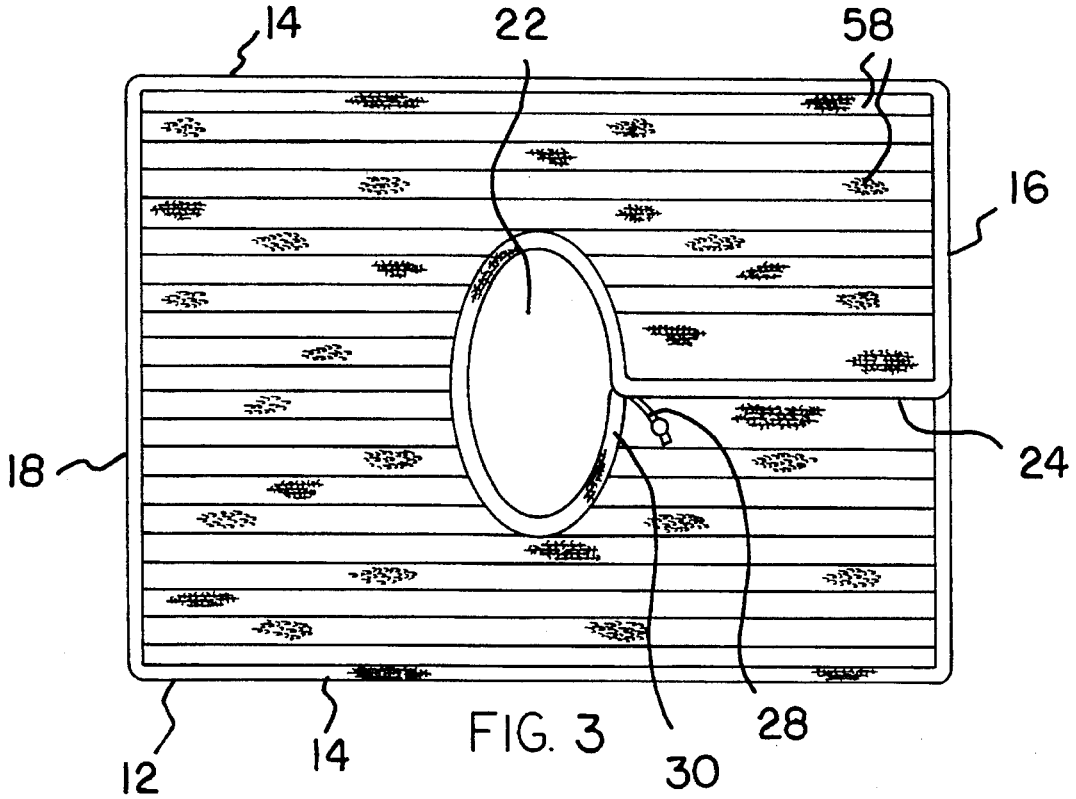
FIG. 3 is a plan view of the garment of the prior Figures in an extended flat orientation.
Figure 4:
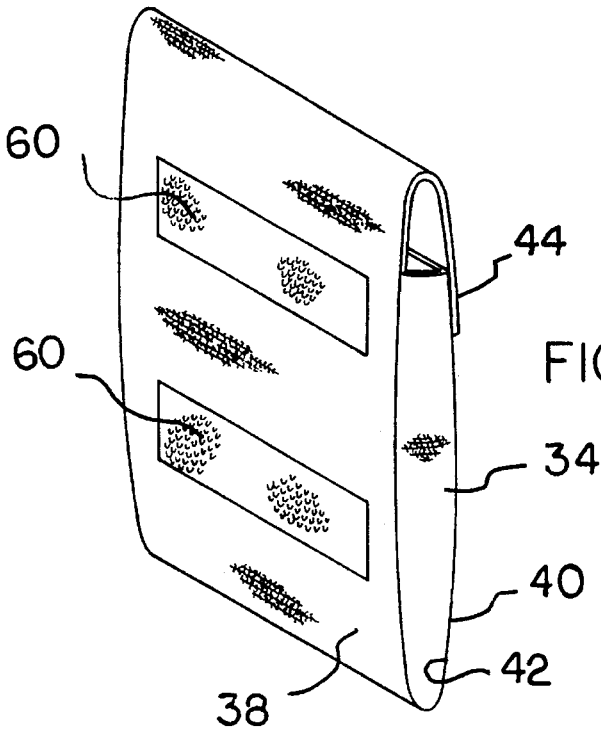
FIG. 4 is a rear perspective view of a typical small pocket with horizontal pile fasteners on its pack side.
Figure 5:
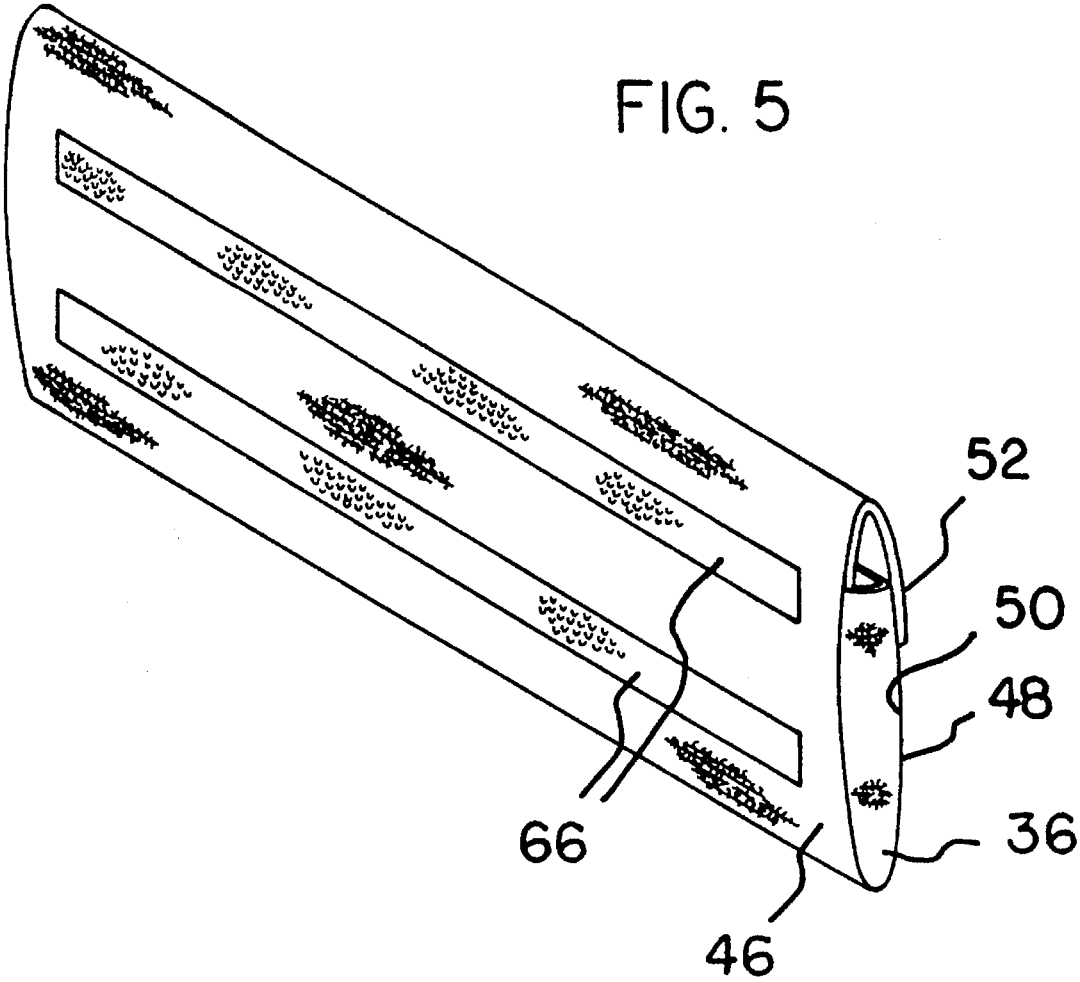
FIG. 5 is a rear perspective view of a typical long pocket with horizontally disposed strips of pile fasteners.
Figure 6:
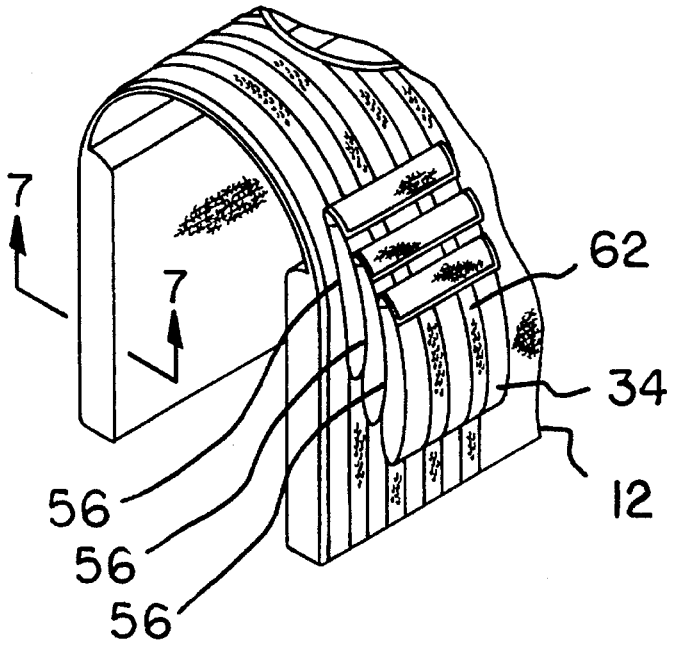
FIG. 6 is a perspective view of a portion of the garment of the prior Figures.
Figure 7:
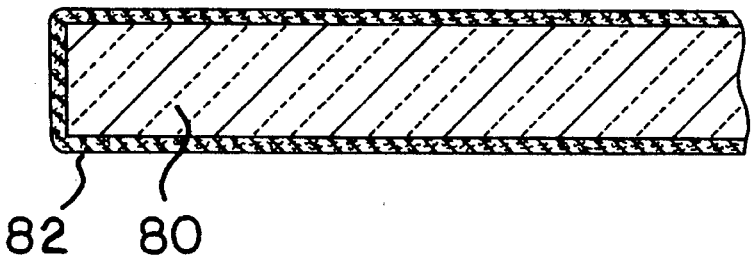
FIG. 7 is a cross sectional view taken along line 7—7 of FIG. 6.

With reference now to the drawings, and in particular to FIG. 1 thereof, a new and improved fishing garment with pockets embodying the principles and concepts of the present invention and generally designated by the reference numeral 10 will be described.

More specifically, it will be noted that, in FIG. 1, that the invention relates to a new and improved garment 10 particularly adapted for wear by fishermen or other sports persons. The garment 10 includes a support member 12 in a generally square configuration. It has side edges 14 and end edges 16 and 18. An oval head opening 22 is generally centrally disposed therein.

The larger axis of the oval is parallel with the end edges 16 and 18. The smaller axis of the oval is parallel with the side edges 14. The long axis constitutes between about 40 and 60 percent, preferably about 50 percent, of the length of the end edges. The short axis constitutes between about 10 to 20 percent, preferably about 15 percent, of the length of the side edges.

A slit in the center of one of the end edges 16, the front edge, extend to the head opening 22. This functions to facilitate donning and removal of the garment.

A plurality of pockets 34 and 36 included for each support member. These include small pockets 34 or large pockets 36. Each small pocket is elongated vertically and has a back face 38 and a front face 40. Stitching 42 or other attachments function coupling the back face 38 and front face 40 along their sides and bottom extent. A flap 44 extends downwardly from the top of the back face 38 over the front face 40.

Each larger pocket 36 is elongated horizontally and has a back face 46, front face 48 and stitching 50 or other attachments which function as with the small pockets 34. Similarly a flap 52 extends from the top of the back face 46 over the top of the front face 48.

Coupling means 56 releasably interconnect the support means 12 and the pockets 34 and 36. In one embodiment, the coupling means include permanent fasteners such as stitching. In another embodiment, the coupling means include a plurality of strips 58 of pile type fasteners secured to the exterior of the support member 12 in spaced relationship parallel to the side edges in cooperating therewith are a plurality of strips 60 of pile type fasteners secured to the back faces of the pockets in spaced relationship parallel with the end edges. A plurality of strips of pile type fasteners 62 are also secured to the exterior of at least some pockets in spaced relationship parallel with the side edges.

The large pockets 36 are also provided with pile type fasteners 66 on the back faces 46 for coupling with the pile type fasteners 58 of the support member. Similarly, strips 68 of pile type fasteners are provided on the front faces 48 of the long pockets 36.

Because of the relationship of the various strips of pile type fasteners or the support member and the small and large pockets, the pockets may be positioned to fulfill the needs of the wearer of the garment at virtually any location, with the pockets on the support member or on other pockets.

If further securement of the garment is desired, a separable fastener is employed to close the slit 24. Various types of fasteners, including a pile type fastener, could be utilized.

The support member is preferably fabricated of a closed cell foam core 80 with an extension of a water-resistent cloth 82 for insulation and floatation, note FIG. 8.

This garment can be worn and utilized in deeper water than the conventional fishing vest without getting wet. It is especially good for float tubes. Its construction will allow adjustments to the pockets for individual needs. The construction also allows for easy access to back pockets by simply rotating the garment without having to remove it. In addition, additional items of apparel may be donned or removed without taking off the garment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garment particularly adapted for wear by fishermen comprising, in combination:

a support member in a generally square configuration having side edges and end edges, an oval head opening centrally disposed therein with the larger axis of the oval being parallel with the end edges and with the smaller axis of the oval parallel with the side edges, the long axis constituting about 50 percent of the length of the end edges and the short axis constituting about 15 percent of the length of the side edges, a slit extending between the center of one of the end edges and the head opening to facilitate donning and removal of the garment with a tie string formed in the support member adjacent to the slit to facilitate opening and closing of the garment;

a plurality of pockets, the pockets having an interior and an exterior and also having a back face and a front face with means coupling the back face and front face along their sides and bottom extent and with a flap extending downwardly from the top of the back face over the front face;

coupling means interconnecting the support means and the pockets; and coupling means including a plurality of strips of pile type fasteners secured to the exterior of the support member in spaced relationship parallel to the side edges and a plurality of strips of pile type fasteners secured to the interior of the pockets in spaced relationship parallel with the end edges and a plurality of strips of pile type fasteners secured to the exterior of at least some pockets in spaced relationship parallel with the side edges.

2. The apparatus as set forth in claim 1 and further including closure means at the slit.

3. The apparatus as set forth in claim 1 wherein the support member is fabricated of a closed cell foam core for insulation and floatation with an exterior fabric thereover.

4. A garment adapted for wear by a sportsperson comprising:

a support member in a generally square configuration having an interior and an exterior and having side edges and end edges, an oval head opening centrally disposed therein with the larger axis of the oval being parallel with the end edges and with the smaller axis of the oval parallel with the side edges, a slit extending between the center of one of the end edges and the head opening to facilitate donning and removal of the garment;

a plurality of pockets, the pockets having back faces and front faces;

coupling means interconnecting the support means and the pockets; and at least some of the pockets having a pile type fastener secured to the front face of the pockets perpendicular to the pile type fastener strips on the back faces of the pockets.

* * * * *